US005540349A

United States Patent [19]

Philips

[11] Patent Number: 5,540,349

[45] Date of Patent: Jul. 30, 1996

[54] CONTAINER CLOSURE WITH SEPARABLE WALL SEGMENTS

[75] Inventor: Terry M. Philips, Willoughby, Ohio

[73] Assignee: Bennett Industries, Inc., Peotone, Ill.

[21] Appl. No.: 399,442

[22] Filed: Mar. 7, 1995

[51] Int. Cl.[6] ..... B65D 41/18

[52] U.S. Cl. ..... 220/306; 206/508; 215/230; 215/DIG. 1; 220/284; 220/322; 220/356; 220/380

[58] Field of Search ..... 220/319–322, 220/284, 713, 356, 357, 306, 712, 269, 276, 281, 254, 711, 380; 215/344, 341, DIG. 1, 342, 230, 250; 206/503, 508

[56] References Cited

U.S. PATENT DOCUMENTS

| | | | |
|---|---|---|---|
| 3,474,928 | 10/1969 | Hurtt . | |
| 3,499,574 | 3/1970 | Yates, Jr. | 220/330 X |
| 3,515,306 | 6/1970 | Roper et al. . | |
| 3,519,163 | 7/1970 | Bardell . | |
| 3,531,013 | 9/1970 | Hammes | 220/356 X |
| 3,532,244 | 10/1970 | Yates, Jr. . | |
| 3,770,156 | 11/1973 | Yates, Jr. . | |
| 4,027,775 | 6/1977 | Nygatt, Jr. et al. | 220/306 X |
| 4,386,715 | 6/1983 | Morton | 220/306 X |
| 4,474,305 | 10/1984 | Marco | 220/284 X |
| 4,625,890 | 12/1986 | Galer | 220/306 X |
| 4,711,364 | 12/1987 | Letica | 220/306 X |
| 4,721,210 | 1/1988 | Lawrence et al. | 220/306 X |
| 4,826,039 | 5/1989 | Landis | 220/306 X |
| 4,966,294 | 10/1990 | Mark et al. | 220/306 X |
| 5,294,015 | 3/1994 | Landis | 220/306 |

FOREIGN PATENT DOCUMENTS

| | | |
|---|---|---|
| 168194 | 12/1956 | Australia . |
| 1008009 | 5/1952 | France . |

*Primary Examiner*—Allan N. Shoap
*Assistant Examiner*—Robin A. Hylton
*Attorney, Agent, or Firm*—D. Peter Hochberg; Mark Kusner; Michael Jaffe

[57] ABSTRACT

A closure or lid for use with a container having an open end and a rim extending along the perimeter of the open end. The closure comprises a center portion which covers the container and an integral wall structure extending along the periphery of the center portion, the wall structure designed to attach the closure to the rim. The wall portion includes an inner wall adjacent the center portion, an outer wall spaced from the rim and a joining wall connecting the inner wall and the outer wall and forming a cavity therebetween, the rim being received into the cavity. The inner surface of the outer wall includes an inwardly extending projection which interlocks with a projection on the container rim and holds the lid onto the container. The outer wall is further provided with a plurality of slots which divide the outer wall into a plurality of separate and individual sections to allow for easy removal.

10 Claims, 4 Drawing Sheets

CONTAINER CLOSURE WITH SEPARABLE WALL SEGMENTS

FIELD OF THE INVENTION

The present invention relates generally to lids for sealing containers and more particularly to a durable, reusable lid which can be removed without the having to first cut or score the lid.

BACKGROUND OF THE INVENTION

Various types of lids for sealing the open ends of containers have been developed. It is desirable that a container lid interlock tightly onto the container it is sealing so as to be able to withstand movement and jarring without coming loose. Additionally, the lid should be capable of supporting the weight of containers stacked on top of it and it should be reusable and relatively simple to open.

U.S. Pat. No. 3,770,156 to Yates, Jr., discloses a tamper-proof plastic closure attachable to the rim of an open-ended container, the closure having a flexible peripheral outer leg including a plurality of slots and a continuous lip below the slots. A bead projecting from the inner surface of the outer leg interlocks with a bead extending outward from the container rim to hold the lid onto the container. To remove the container, the lip is cut below the slots, dividing the outer wall into individual sections, so that the outer wall can be pivoted upward, thus pivoting the bead out of locking engagement with the leg of the rim.

U.S. Pat. No. 3,532,244 to Yates, Jr., discloses a plastic closure having a U-shaped channel which sealingly engages the rim of an open end of a container. The U-shaped channel has an upper wall and contains a plurality of flanges which extend downward from the upper wall of the channel and contact the rim, thereby creating a liquid-tight seal, when the closure is mounted on the container. The rim includes an annular ridge which directs the flanges to either side of the rim in order to create a tight seal and prevent the flanges from being crushed.

U.S. Pat. No. 3,519,163 to Bardell discloses a plastic container lid for shipping containers. The lid comprises a central top wall and a U-shaped channel extending about the periphery of the top wall. The channel includes an inner wall, an outer wall and an integral top section which connects the inner and outer flanges. Interlocking means are provided on the interior surface of the outer wall which lockingly engage the side wall structure of the container. Release means are provided which are at least one vertically-oriented tear line formed in the outer flange for separating the lower portion of the outer flange into two or more separate sections. The outer flange is separated by slitting the tear line with a screwdriver or the like. Afterwards, the closure can be removed from the container body.

U.S. Pat. No. 3,515,306 to Roper et al. discloses a container with cover and hidden cover release formed onto the container. The cover includes a center wall and a U-shaped edge portion extending about the center wall for mounting the cover onto the rim of the container. The outer surface of the container wall has an annular deflection rib and an annular engagement rib. The end of a screwdriver can be wedged between the deflection rib and the outer wall of the container with its shaft resting against the engagement rib. The user opens the container by pressing the screwdriver handle towards the container wall, whereby the engagement rib acts as a lever, and the end of the screwdriver pushes the outer flange of the cover out of sealing engagement with the container rim.

U.S. Pat. No. 3,474,928 to Hurtt discloses a container having snap fastening means. The rim of the container has an outwardly extending rectangular bead extending therefrom which is engaged by a generally U-shaped channel extending along the perimeter of the closure. The center portion of the closure is offset from the U-shaped channel so that it fits within the cavity defined by the side wall of the container thereby strengthening it. Locating ribs are formed on the top of the container to position containers during stacking.

SUMMARY OF THE INVENTION

In accordance with the present invention a closure or lid for a container having an open end is provided. The closure is basically an integral structure, preferably formed of a plastic, such as polyethylene. The closure comprises a center wall portion, which covers the container and an outer wall structure extending about the periphery of the wall portion. The outer wall structure includes an inner wall, formed next to the center portion, ah outer wall, which is spaced from and generally parallel to the inner wall and a joining wall connecting the inner and outer walls, a cavity being formed therebetween. The outer wall includes a protrusion on its inner surface, which extends into the cavity, the protrusion interlocking with a corresponding outward extending protrusion on the upper rim of the container to hold the closure onto the container. A plurality of dividing members are formed in the outer wall of the closure and extend through the bottom edge of the outer wall. The dividing members thereby divide the outer wall into individual sections, allowing each individual section to be pried upward and outward so that the closure may be removed from the container.

It is an object of the present invention to provide a lid for a container which can be removed without having to use cutting tools and without having to physically alter the lid.

Another object of the present invention is to provide a lid as described above which can be reinstalled after it is removed.

Another object of the present invention is to provide a lid as described above which includes a center covering portion and an outer portion for sealing to the rim of a container.

Another object of the present invention is to provide a lid as described above wherein said outer portion includes an inner wall, an outer wall spaced from said inner wall and a wall joining the inner wall to the outer wall, a cavity being defined therebetween.

Another object of the present invention is to provide a lid as described above wherein said outer wall has an inner surface and a projection extending from the inner surface into the cavity, the projection interlocking with a corresponding projection on the container to hold the closure onto the container.

Another object of the present invention is to provide a lid as described above wherein the outer wall contains a plurality of dividing members which divide the outer wall into a plurality of separate, individual sections.

Another object of the present invention is to provide a lid as described above which is made of plastic, preferably high density polyethylene.

Another object of the present invention is to provide a lid as described above which is economical to manufacture and simple to use.

These and other objects of the invention will become apparent to those skilled in the art upon a reading of the detailed description, drawings and claims.

DETAILED DESCRIPTION OF THE PREFERRED EMBODIMENT

Figure 1:
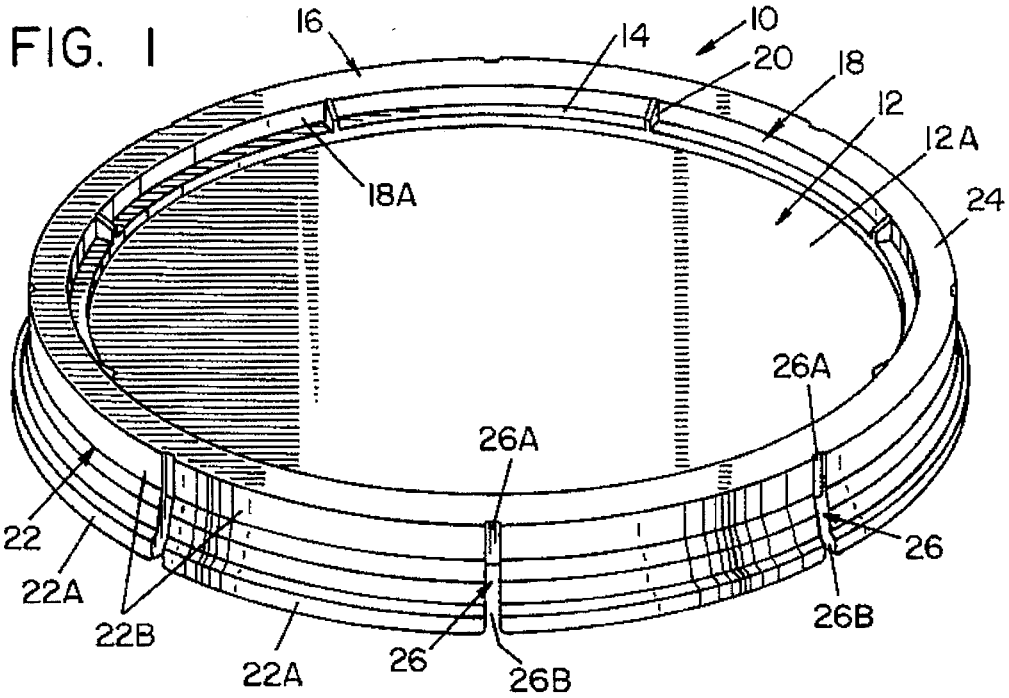
FIG. 1 is top front perspective view of a closure or lid made in accordance with the present invention.
Figure 2:
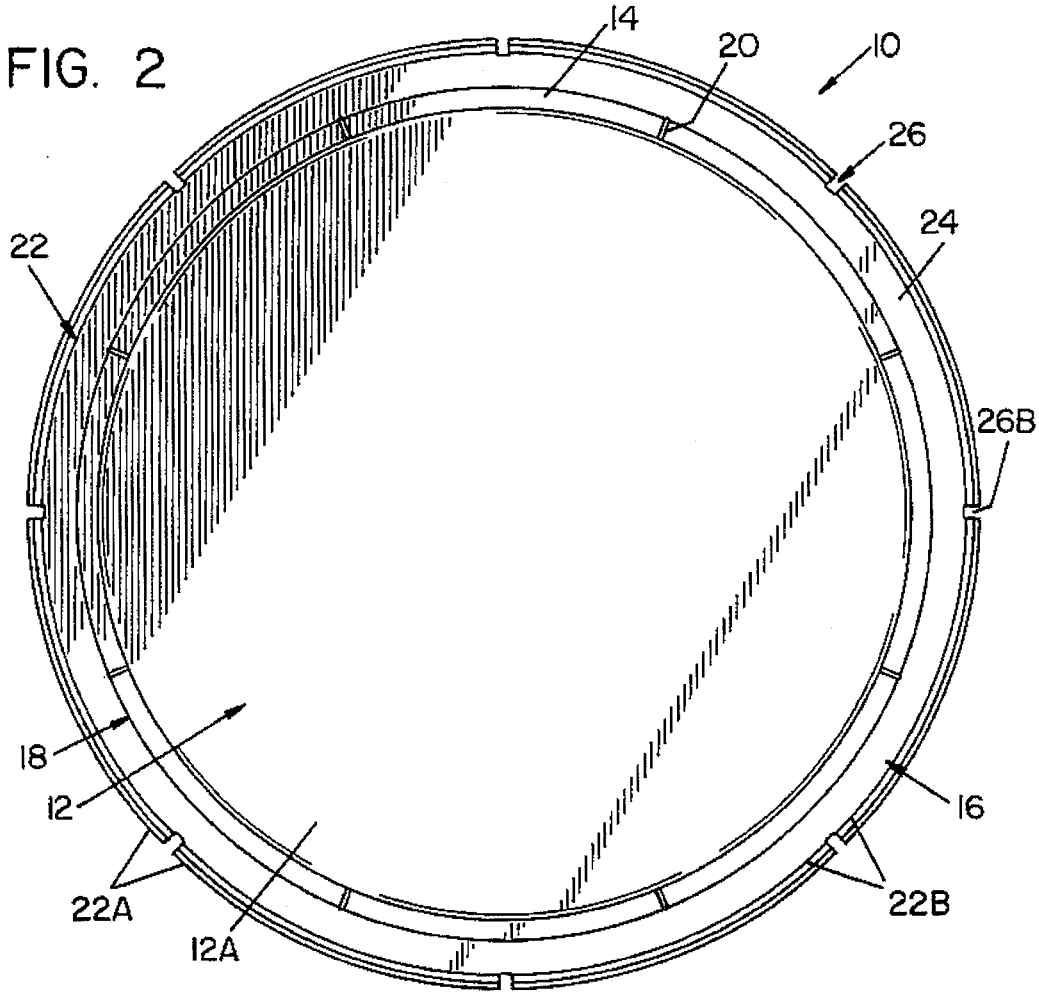
FIG. 2 is a top plan view of the lid shown in FIG. 1.
Figure 3:
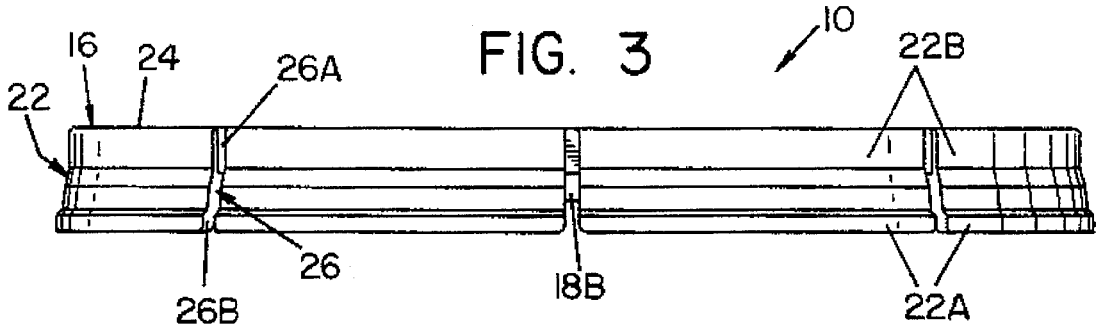
FIG. 3 is a side elevational view of the lid shown in FIG. 1.
Figure 4:
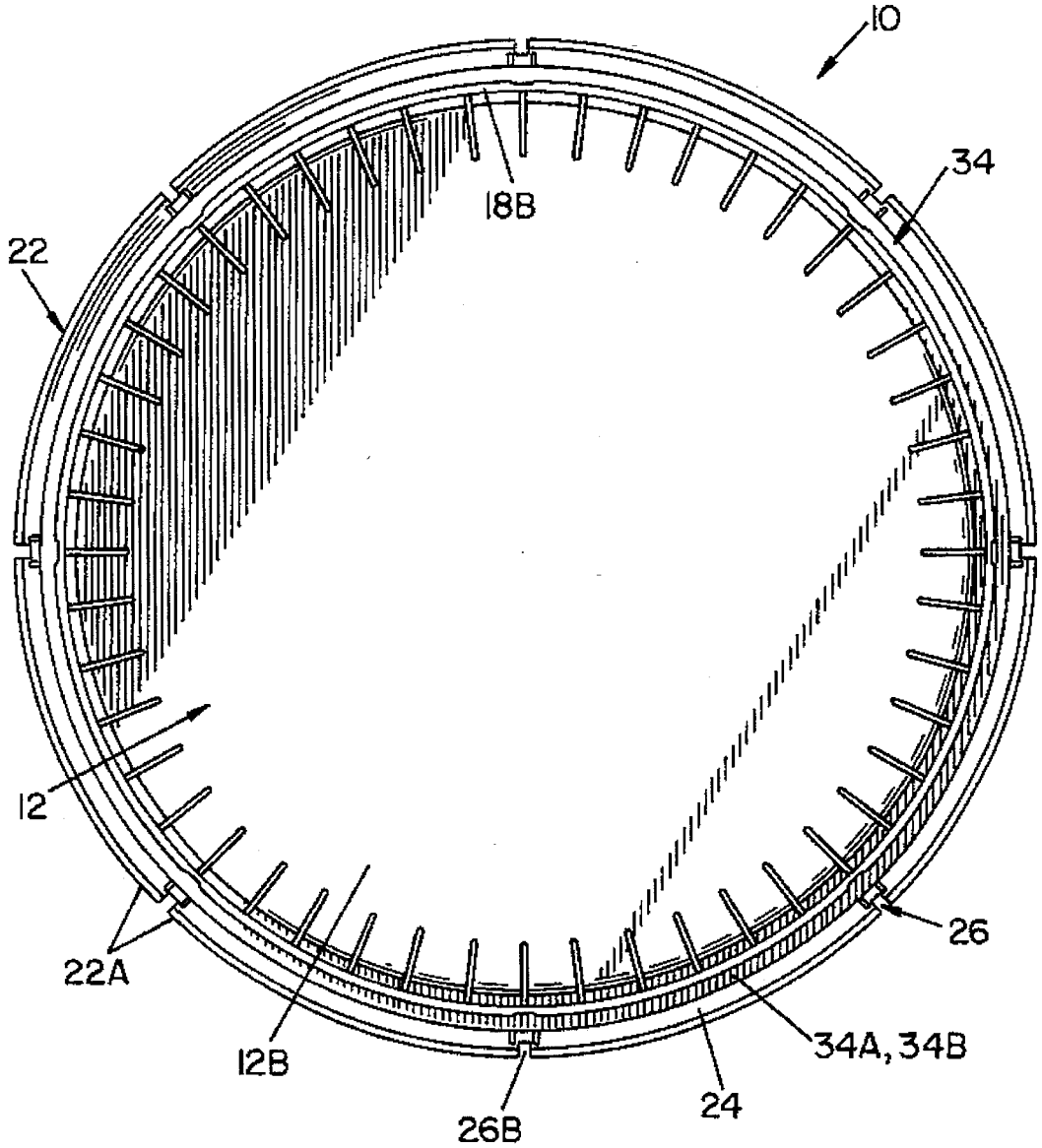
FIG. 4 is a bottom plan view of the lid shown in FIG. 1.
Figure 5:
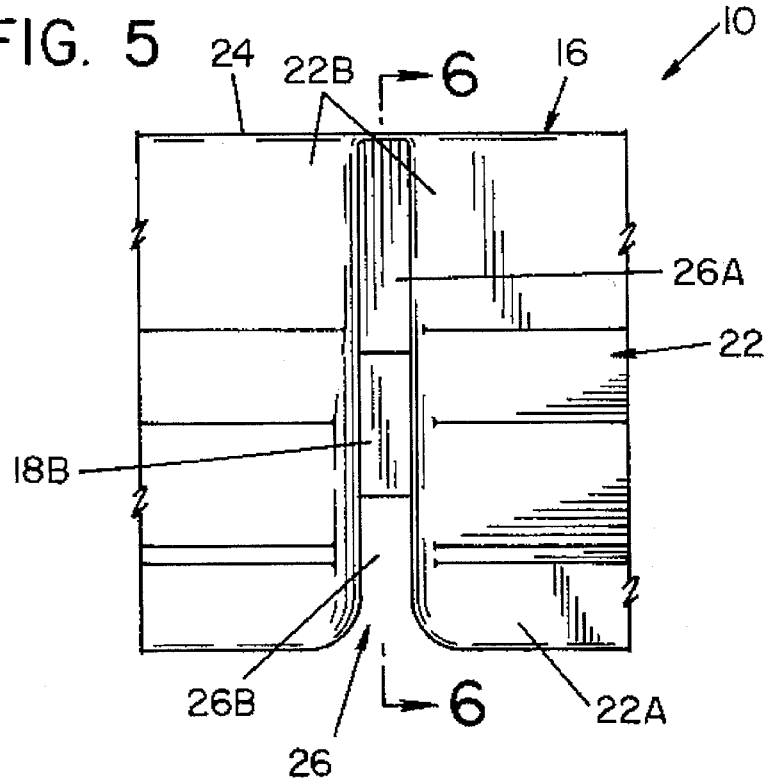
FIG. 5 is an enlarged, partial side view of the lid shown in FIG. 3 showing the slot.

Turning now to the drawings where the purpose is for showing a preferred embodiment, FIG. 1 shows a container closure lid 10 made in accordance with the present invention. Container lid 10 is preferably formed of a high-density polyethylene. Container lid 10 has a center portion 12 which, in the embodiment shown, is generally circular with a generally flat top surface 12A and a generally flat lower surface 12B, which is best seen in FIG. 4. A lip 14 is a raised portion having a generally rectangular cross-section which is integrally formed around the perimeter of center portion 12. An integral wall structure 16 is peripheral to the outer part of lip 14. Wall structure 16 includes an inner wall 18, an outer wall 22 and an intermediate or joining wall 24. Walls 18, 22 and 24 define a cavity 34 inside of wall structure 16. Interior wall 18 is annular and smooth and is integrally formed with, and peripherally disposed to, lip 14. Wall 18 is generally vertically oriented and perpendicular to center portion 12, extending above and below center portion 12. Interior wall 18 includes a lower portion 18B as seen in FIGS. 3 and 5, which extends below center portion 12, and an upper portion 18A which extends above center portion 12. A plurality of radial centering tabs 20 are integrally formed between lip 14 and upper portion 18A of interior wall 18. Tabs 20 are thin, flat walls which extend vertically from lip 14 and terminate at the top of upper portion 18A and which extend radially inward from upper portion 18A and terminate at an inner wall of lip 14. The upper portions of tabs 20 are angled inward toward the center of center wall 12 so as to facilitate the centering of containers onto wall 12.

Exterior wall 22 is spaced a predetermined distance from interior wall 18. Wall 22 is generally smooth and annular and extends about the periphery of container lid 10. Wall 22 flares radially outward and has a lower outwardly extending bead 22A integrally formed along its lower edge. Lower bead 22A is stepped out from wall 22 and is formed so that it is generally vertically oriented. Bead 22A provides a structure which can be used to pry lid 10 off of a container with a screwdriver or similar tool, which will be discussed fully below.

A joining wall 24 is integrally formed between interior wall 18 and exterior wall 22 thereby joining the two and forming cavity 34. The joining wall is generally flat and annular and perpendicular to walls 18 and 22.

A plurality of dividing members 26 are formed in exterior wall 22. Dividing members 26 are generally elongated, rectangular and contain a closed upper wall portion 26A and a fully open slot portion 26B. The open slot portion 26B of dividing members 26 extend through lower bead 22A and divide the lower portion of exterior wall 22 into separate sections 22B.

Figure 6:
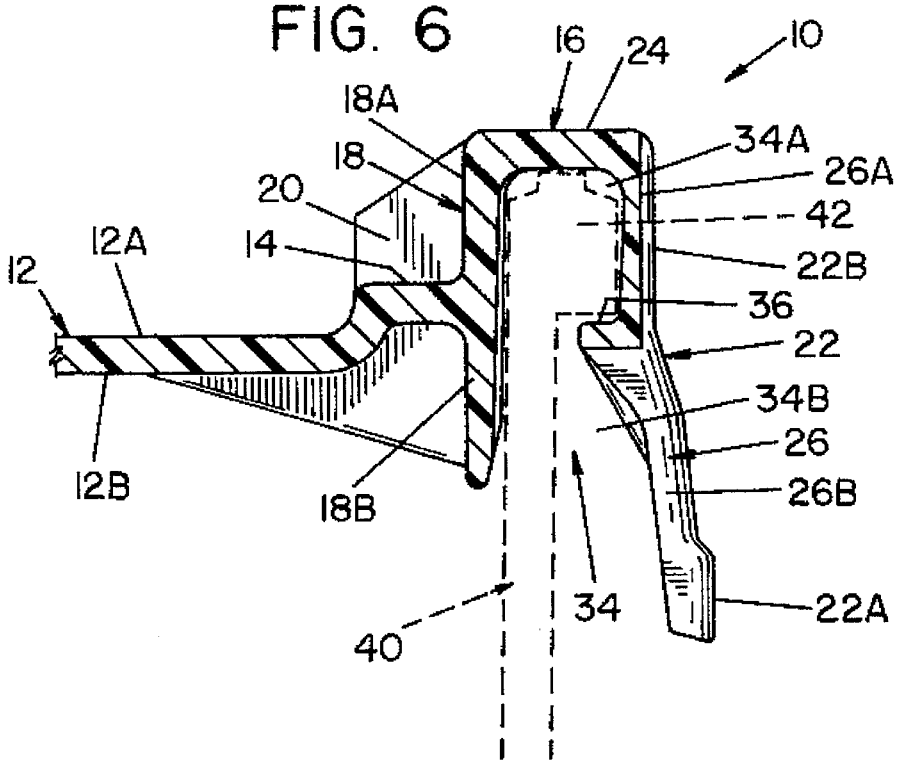
FIG. 6 is an enlarged, partial, sectional view taken along lines 6—6 of FIG. 5, where the lid is mounted on a container.

A projection 36 extends inward from exterior wall 22 into cavity 34 in a generally horizontal direction. Projection 36 interlocks with a corresponding outward projection on a rim 42 of container 40 rim thereby fastening lid 10 onto container 40 (FIG. 6). Projection 36 divides cavity 34 into an upper portion 34A, which receives the upper edge of rim 42, and a lower portion 34B. Closure 10 is sealed to container 40, by placing lid 10 on the open end of container 40 and applying pressure to the top of joining wall 24 which pushes U-shaped wall structure 16 down onto rim 42 of container 40 so that rim 42 is positioned within cavity 34A and the outward extending projection on rim 42 is positioned above and interlocks with projection 36.

Closure 10 is removed from the container by using a tool, such as a screwdriver, to pry each individual wall segment 22B upward and outward so as to move projection 36 out of interlocking engagement with projection on the container 40.

Figure 7:
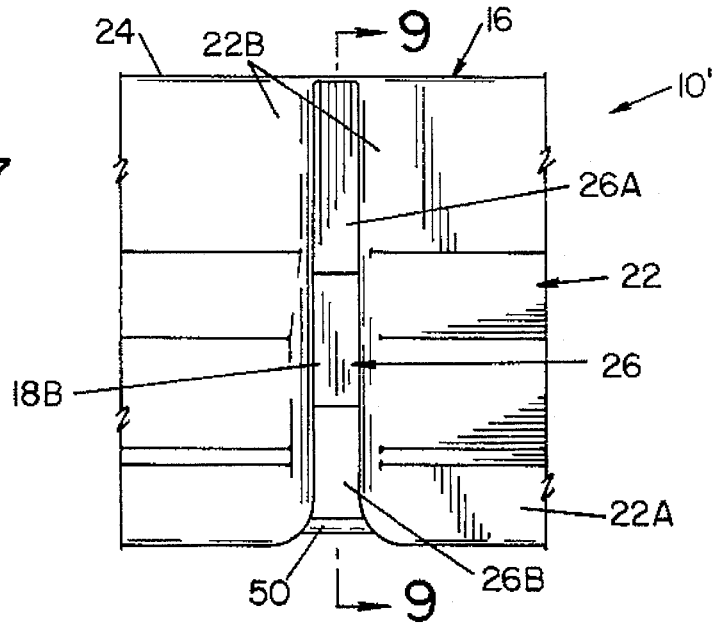
FIG. 7 is a partial, side view of a second embodiment container lid made in accordance with the present invention, showing the opening slot.
Figure 8:
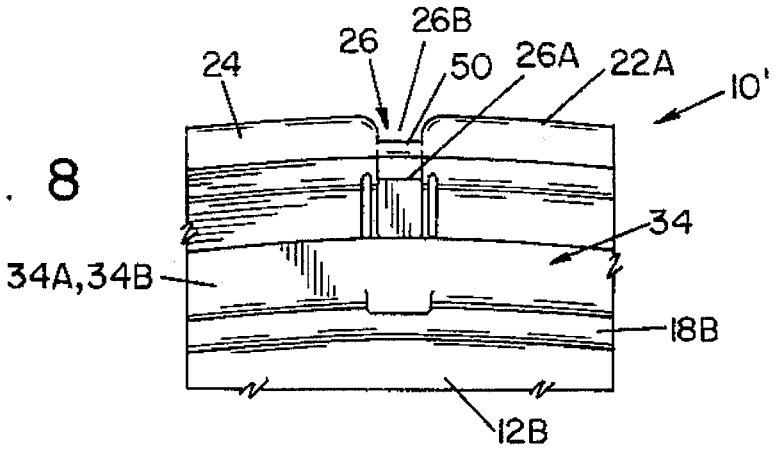
FIG. 8 is an enlarged, partial sectional bottom view of the lid shown in FIG. 7.
Figure 9:
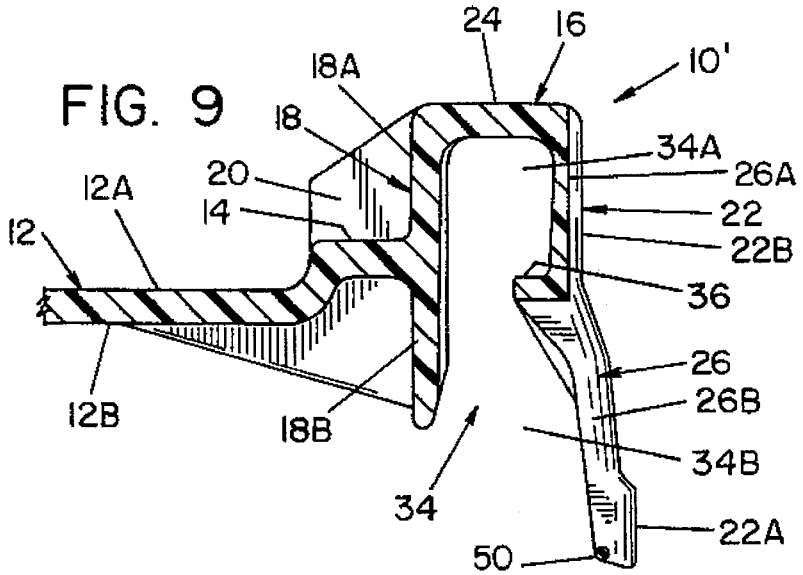
FIG. 9 Is a partial enlarged sectional view taken along lines 9—9 of FIG. 7.

The second embodiment shown in FIGS. 7–9 employs an embodiment for rendering the closure tamper evident. In FIGS. 7–9, most of the structural components are the same as those in FIGS. 1–6, and have the same numerical components. Here, however, a strand of plastic 50 runs peripherally through the adjacent lowermost ends of wall 22. The modified closure 10' is placed on a container with a downward force used to force closures 10 on their containers, except that strands 50 stretch as the closure 10' passes the rim of a container. In order to remove closure 10', strands 50 must be stretched and wall segments 22B must be pried upward and outward. One can tell if a closure has been removed because of the stretching of strands 50.

The invention has been described in detail with particular emphasis on the preferred embodiments but variations within the spirit and scope of the invention may occur to those skilled in the art.

What is claimed is:

1. A closure for removable attachment to a rim of an open end of a container, said closure comprising:

a) a disk-shaped center section having generally planar upper and lower surfaces, and a perimetrical edge, b) a side wall structure integrally formed about said perimetrical edge, said side wall structure providing a generally annular peripheral U-shaped cavity for sealing said closure to said container, said side wall structure comprising:

i) a generally annular interior wall formed adjacent and generally perpendicular to said center section, ii) a generally annular exterior wall spaced a predetermined distance from said interior wall and oriented generally perpendicular to said center section, said exterior wall having:

a lower edge, an inner surface facing said interior wall, a projection extending from said inner surface for sealingly engaging a projection extending from the rim of said container, and a plurality of dividing members, each said dividing member including a slot and a closed wall segment, said slot extending through said lower edge thereby making said lower edge discontinuous and separating said exterior wall into a plurality individual and separate lower exterior wall segments, and said closed wall segment extending between the top of each said slot to said joining wall, said closed wall segments having the same width as said slots, and iii) a joining wall connecting said interior wall and said exterior wall, said joining wall generally parallel to said center section.

2. A closure as described in claim 1, wherein said center section further comprises centering tab members formed adjacent to said interior wall and said upper surface of said center section.

3. A closure according to claim 1, wherein said center section includes a generally annular lip member defining said perimetrical edge.

4. A closure as described in claim 1, wherein said closure is made of plastic.

5. A closure as described in claim 4, wherein said plastic is polyethylene.

6. A closure according to claim 1, and further including connecting means extending across said slot formed between adjacent lower exterior wall segments, said connecting means being unstressed when said closure is positioned on a container and being stretchable in order to remove said closure from said container.

7. A closure according to claim 6, wherein said connecting means is a strand.

8. A closure for removable attachment to a rim of an open end of a container, said closure comprising:

a) a disk-shaped center section having generally planar upper and lower surfaces, and a perimetrical edge, b) a side wall structure integrally formed about said perimetrical edge, said side wall structure providing a generally annular peripheral U-shaped cavity for sealing said closure to said container, said side wall structure comprising:

i) a generally annular interior wall formed adjacent and generally perpendicular to said center section;

ii) a generally annular exterior wall spaced a predetermined distance from said interior wall and oriented generally perpendicular to said center section, said exterior wall having:

a lower edge, an inner surface facing said interior wall, a projection extending from said inner surface for sealingly engaging a projection extending from the rim of said container, and slots extending through said lower edge thereby making said lower edge discontinuous and separating said exterior wall into a plurality of individual and separate lower exterior wall segments, and iii) a joining wall connecting said interior wall and said exterior wall, said joining wall generally parallel to said center section; and c) connecting means connected to said lower exterior wall segments, and extending across said slots formed between adjacent lower exterior wall segments, said connecting means being unstressed when said closure is positioned on a container and being stretchable in order to remove said closure from said container.

9. A closure according to claim 8, wherein said connecting means is a strand.

10. A closure according to claim 8, wherein said exterior wall includes a closed wall segment extending from the top of each said slot to said joining wall, said closed wall segments having the same width as said slots.

* * * * *